US005709173A

United States Patent [19]

Ahtila et al.

[11] Patent Number: 5,709,173

[45] Date of Patent: Jan. 20, 1998

[54] METHOD AND APPARATUS FOR CONTROLLING COMBUSTION AIR IN A BOILER PLANT

[75] Inventors: Pekka Ahtila, Espoo; Jaakko Haapio, Tampere, both of Finland

[73] Assignee: Kvaerner Pulping Oy, Tampere, Finland

[21] Appl. No.: 559,095

[22] Filed: Nov. 16, 1995

[30] Foreign Application Priority Data

Nov. 17, 1994 [FI] Finland ..... 945404

[51] Int. Cl.[6] ..... F22B 33/00

[52] U.S. Cl. ..... 122/1 C; 454/229; 454/236; 236/1 G

[58] Field of Search ..... 454/229, 236; 122/13.1, 14, 15, 16, 17, 1 C; 236/1 G

[56] References Cited

U.S. PATENT DOCUMENTS 3,703,919 11/1972 Owens et al. ..... 122/7 C
4,245,779 1/1981 Ardiente ..... 236/1 G
5,007,354 4/1991 Uppstu ..... 122/7 C

FOREIGN PATENT DOCUMENTS 281 506 9/1988 European Pat. Off. .
451 755 10/1987 Sweden .

*Primary Examiner*—Noah P. Kamen
*Attorney, Agent, or Firm*—Pollock, Vande Sande & Priddy

[57] ABSTRACT

A method for controlling combustion air in a boiler plant, where combustion air is supplied into a boiler located in a boiler building, comprises the steps of determining a ratio of air flow inside the building to air flow outside the building on the basis of at least the temperature of the outside air and of a load of the boiler; taking a first air flow from inside of the building in accordance with the ratio; taking a second air flow from outside the building in accordance with the ratio; the second air flow being at a certain temperature; and supplying a combined combustion air flow including the first and second air flows, in accordance with the ratio, to the boiler. Also an apparatus is provided for controlling combustion in boiler building permitting it to achieve the above steps.

16 Claims, 5 Drawing Sheets

METHOD AND APPARATUS FOR CONTROLLING COMBUSTION AIR IN A BOILER PLANT

FIELD OF THE INVENTION

The invention relates to a method for controlling combustion air in a boiler plant. The invention relates also to an apparatus for controlling combustion air in a boiler plant.

BACKGROUND OF THE INVENTION

The invention is suitable for use particularly in connection with boiler plants placed in buildings substantially closed from outside air. In this context, the term boiler plant indicates a combustion plant where either solid, liquid or gaseous fuels are burned by means of air. The boiler it-self is manufactured of water-cooled tube panels, the heat produced by combustion being transferred to the water flowing inside the tube panels. Thus steam will be produced which can be later utilized in the process.

Boiler plants include for example the black liquor recovery boiler. In the black liquor recovery boiler, all the combustion air required is currently supplied from the inside of the boiler building, and most of it from its upper part. Because heat released into the boiler building from the boiler and the associated devices will not be sufficient, depending on the location of the boiler, to heat the fresh replacement air and the building to a sufficient degree in the coldest seasons and, on the other hand, natural air exchange is not sufficient to cool down the building to a sufficient degree during warm seasons, the heaters and ventilation equipment of the building must be used for additional heating and ventilation.

The building acts as an air duct, and because the quantity of air required by the boiler is very large, a considerable negative pressure will be produced in the lower part of the building by the need for replacement air and by the duct effect of the high house. This will increase the proportion of uncontrolled air leaks in the replacement air, increase freezing risks in the plant and make the operation of doors more difficult. Further, the operation of the plant will be immediately disturbed upon failure of ventilation in the building, because alternative operation modes compensating for broken equipment are not possible.

Further, some solutions are previously known, in which combustion air is supplied to the boiler from both the inside and the outside of the building, wherein combustion will not be dependent on air supplied only from the inside For example U.S. Pat. 4,245,779 discloses inlet arrangements for combustion air into the heating furnace of a dwelling house. Air is supplied to the same furnace both from the inside and from the outside, whereby draft and flow of cold fresh air through door and window structures can be avoided.

Also published European Patent Application 281 506 discloses a method for mixing air from the outside and air from the boiler room as combustion air to be supplied to the burners.

Further, published Swedish Specification 451 755 presents a method for controlling combustion air. In a specific mixing device, preheated warm air is mixed with cold air e.g. supplied from the outside. The purpose is to keep the mass flow constant by adjusting the temperature measured after mixing to a predetermined set value, i.e. the air flows are mixed in a suitable quantity ratio.

However, the techniques presented above do not provide sufficient control of air flows in boiler buildings during long-term use with varying conditions. Consequently, it is the ratio of air flows supplied from the inside of the building and from the outside that is important.

SUMMARY OF THE INVENTION

It is an aim of the invention to eliminate the above disadvantages and to present a method and an apparatus for better control of air flows in boiler buildings, particularly in regions where temperature variations can be great during a shorter or longer period of time, e.g. within a day or within a year. Further, it is an aim of the invention to present a method and an apparatus for eliminating disadvantages caused by failures or malfunctions of ventilation equipment.

According to the invention, it is expressly the ratio of air flows supplied from the inside of the building and from the outside that is important. This ratio will be determined on the basis of at least the temperature of the outside air and the load of the boiler. The dependency of the ratio on these factors can be determined by tests for each plant, and the ratio can be continuously adjusted on the basis of these factors. When air is supplied to the combustion air duct, both from the inside and from the outside of the building, the process will not be dependent on combustion air supplied from the inside only and its quantity can be adjusted in a more flexible way according to the situation, not affecting the combustion process itself. Also, in case of failure or maintenance of the ventilation system, it is possible to run the boiler plant during repair work by supplying the combustion air directly from the outside. The combustion air duct can be equipped with a mixing section for adjusting the ratio of air flows from the inside and the outside of the boiler building to a desired level. For example, the temperature $t_{mix}$ of the combined flow of the above-mentioned flows can be used as a set value, whereby this temperature is continuously observed and the ratio is adjusted to comply with this. The optimal set value is pre-calculated on the basis of precisely known heat losses to correspond to each momentary outside temperature and boiler load. The aim of the set value is to utilize all the extra heat conducted to the interior, taking into account the guarantee values of the interior temperatures. If the temperature of the plant raises above the limit value, the set value temperature of the mixing point of the combustion air will be raised, whereby a larger quantity of the combustion air will be supplied from the boiler room, and in the opposite situation, the set value temperature will be lowered and the air intake from the boiler room will be reduced.

By using the invention, the operating efficiency of boiler plants can be raised, because the air flows and their temperatures are better control.

The boiler can be, for example a black liquor recovery boiler. In the black liquor recovery boiler, spent liquor called black liquor, originating from sulfate or sulfite cellulose processes of the pulp manufacturing industry, is burned as one part of the recovery process of the chemicals. The heat generated by combustion is recovered in the same way as in an ordinary steam boiler. The invention is not, however, limited only to black liquor recovery boilers but it can be used in all other types of boiler where similar problems exist.

In the following, the invention will be described in more detail with reference to the appended drawings.

DETAILED DESCRIPTION OF THE PREFERRED EMBODIMENTS

Figure 1:
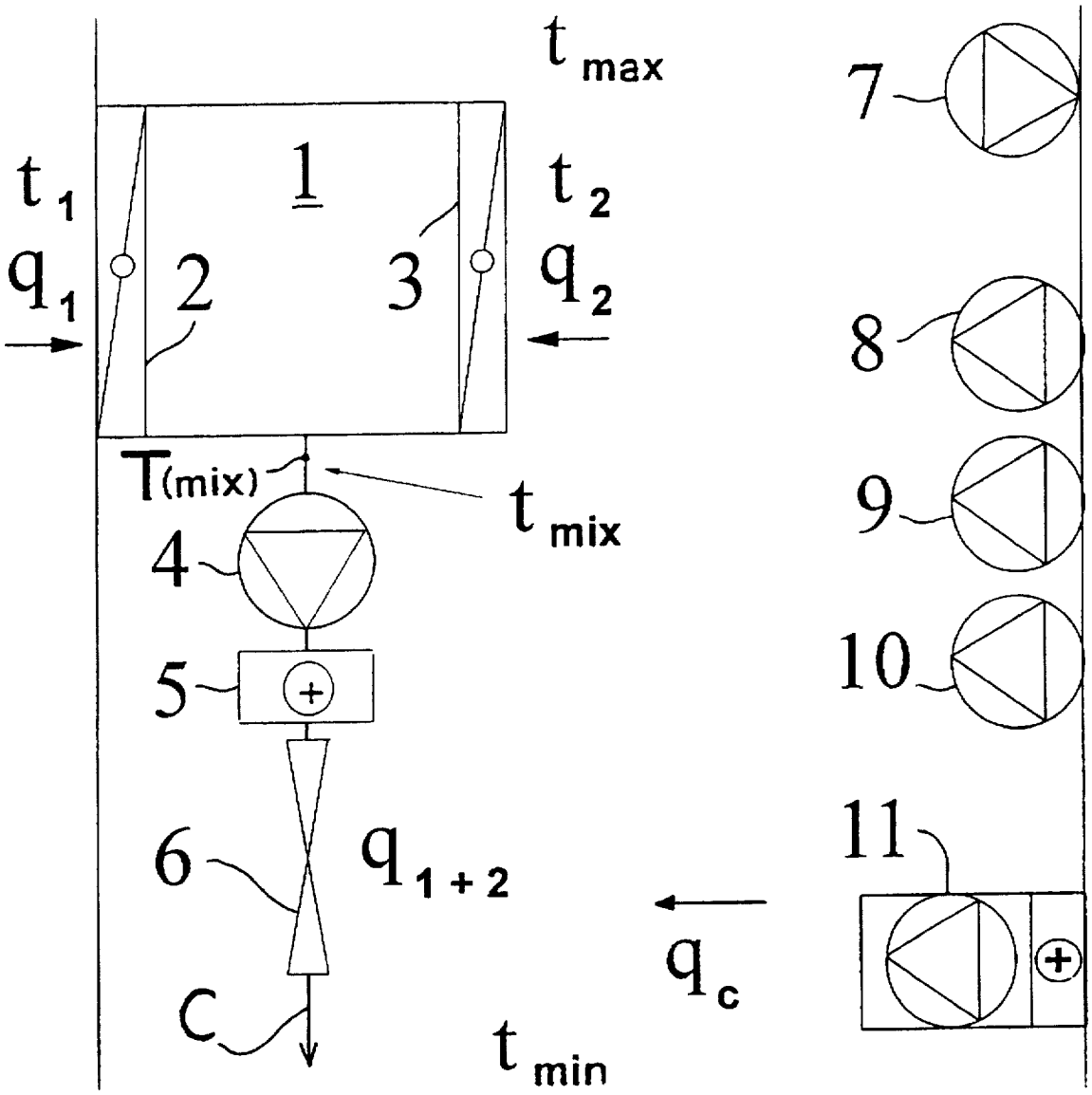
FIG. 1 illustrates schematically air flows in a boiler building, an apparatus according to the invention, and ventilation equipment.

A boiler building for the part concerning the air flows and devices controlling them is shown schematically in FIG. 1. Combustion air is led to a boiler (not shown) through a combustion air duct C. In the beginning of the combustion air duct C there is a mixing section 1, which is connected to air mass within the building and to air outside the building at an outside temperature determined by the meteorological conditions. The first air flow $q_1$ from the outside and a second air flow $q_2$ from the inside is led to mixing section 1 through corresponding control devices 2 and 3, such as dampers. By adjusting the control devices 2 and 3, a desired ratio of the above-mentioned partial flows is reached, whereby the amount of the air flow taken from the inside can be varied according to the situation without influencing the total combustion air flow introduced to the boiler, because the partial flow taken from the outside will allow flexibility in the adjustment.

Figure 2:
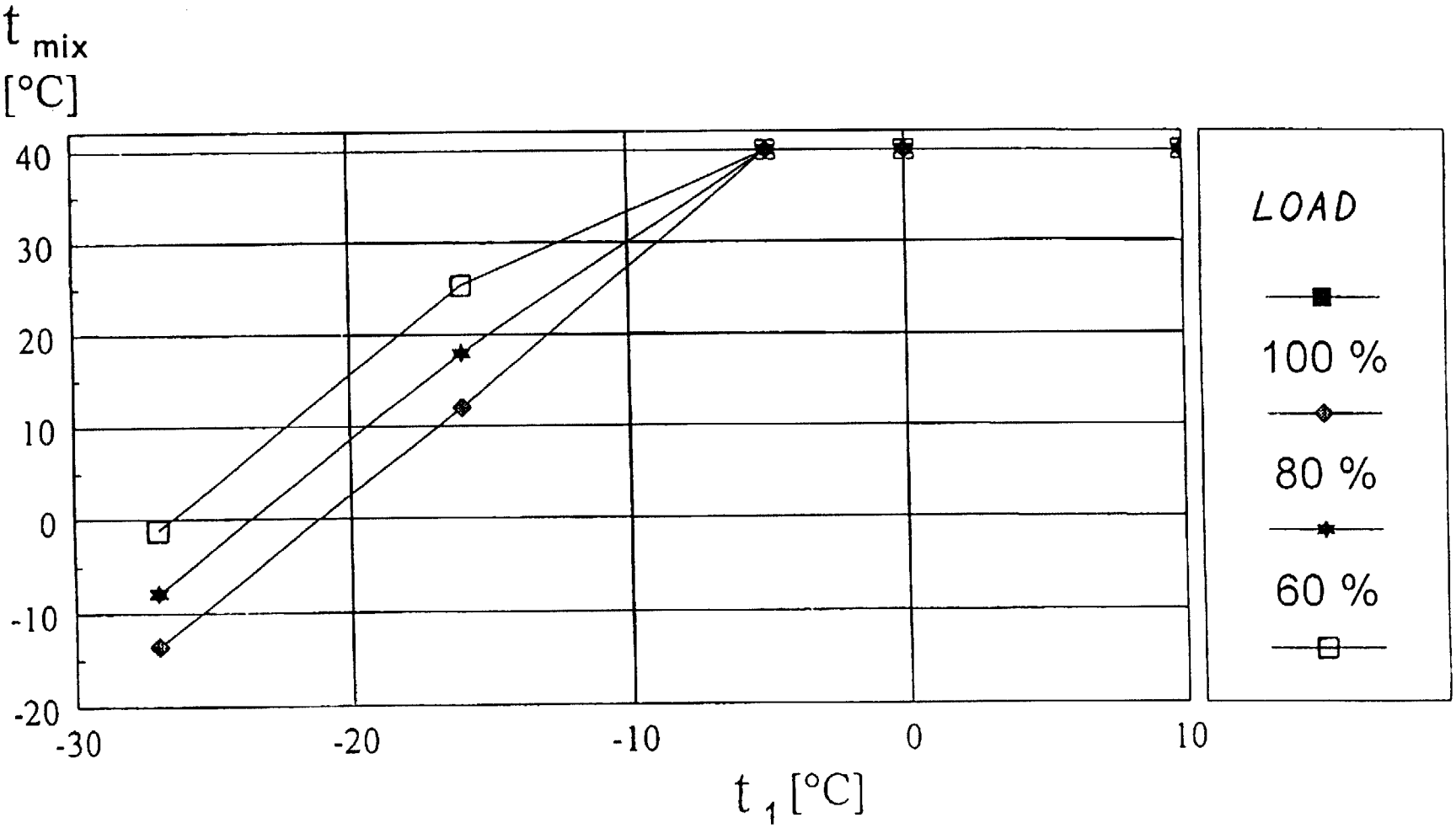
FIG. 2 shows one example of the grounds for adjusting the air flows.

For example, the ratio of the partial flows can be adjusted on the basis of the temperature of the outside air and the load of the boiler. FIG. 2 shows a calculated or experimentally determined temperature of the combined combustion air flow in an ideal situation as a function of the outside air temperature at different boiler load values in a boiler building. This temperature of the combined combustion air flow can be taken as a set value, whereby the control devices 2 and 3 are continuously adjusted to give a ratio of partial flows that realizes this value. In this manner it can be ensured that the air flow taken from the inside is correctly dimensioned considering the heat which is released to the building and is dependent on the boiler load at each moment, as well as considering the temperature of the outside air, that is, the inlet replacement air. The set value can be measured by a sensor T(mix) located in the combustion air duct C after the mixing section 1 and shown in the example of FIG. 1 situated before a combustion air fan 4 and a heater 5.

Figure 3:
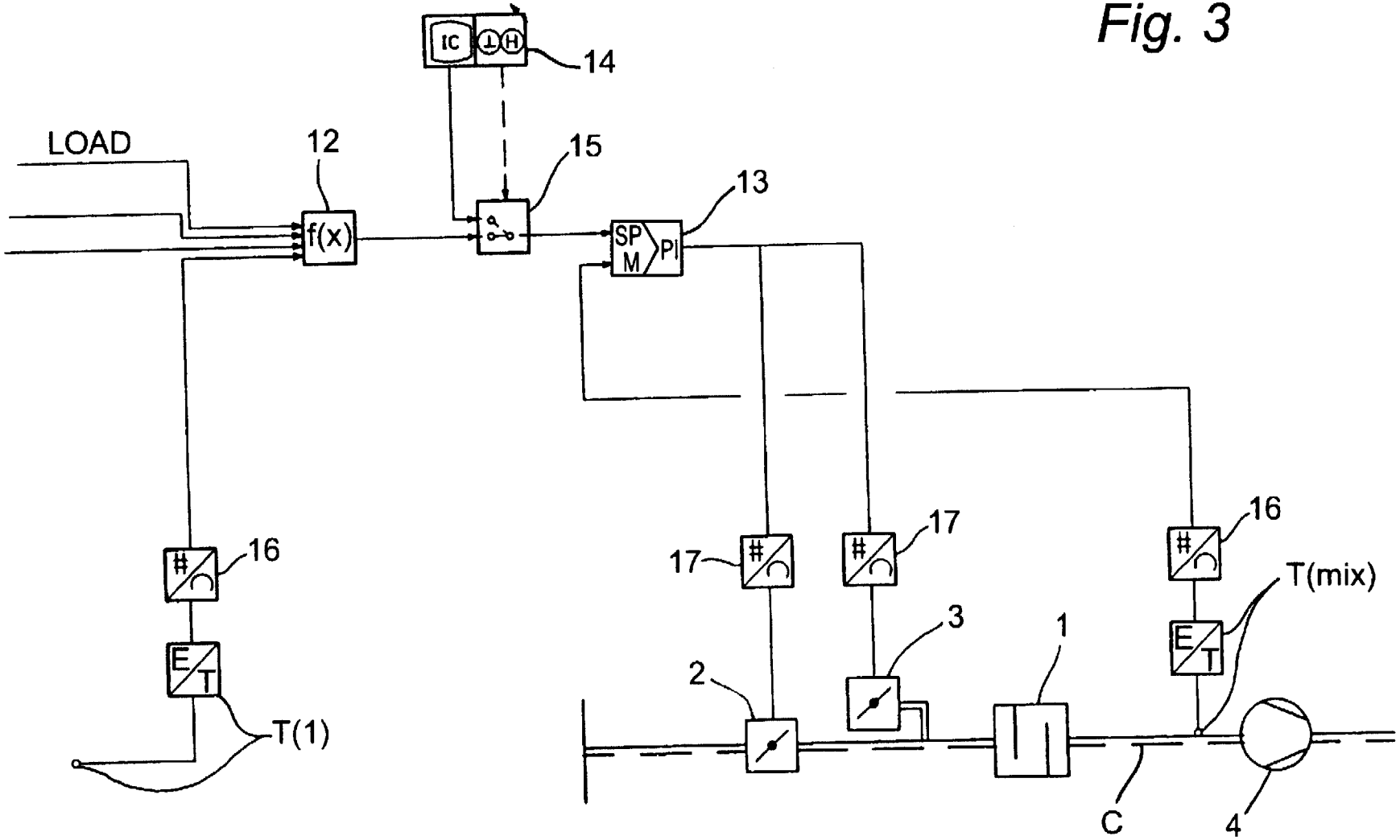
FIG. 3 shows one control diagram for the apparatus according to the invention.

FIG. 3 shows a control diagram for adjusting the mixing of air flows in the mixing section 1, and corresponding parts are designated therein by the same reference numerals as in FIG. 1. The reference numeral of the temperature sensor designates the sensor itself and the corresponding temperature transmitter. The load of the boiler is measured by means of flow measurement on steam production. The data about the boiler load and the temperature, measured by a temperature sensor T(1), enter the computing section 12, which determines the set value $t_{mix}$ for the air flow of the combustion air duct C automatically on the basis of these data. This set value can further be changed on the basis of temperature measurements in the upper and lower parts of the boiler room. The sensor T(mix) measures this air flow and gives the temperature data to a comparator unit 13 which compares the data with the set value given by the computing section 12. Based on this comparison, control messages leave the comparator unit for the control device 2 of the outside air and for the control device 3 of the inside air. Further, a manual adjustment of the control devices is provided by changing the set value for example, in a control room 14 through a switch 15 situated in the data transmission line between the computing section 12 and the comparator unit 13. Further, in FIG. 3, the analog-to-digital converters situated after the temperature sensors T(1 ) and T(mix) are designated by reference numeral 16 and digital-to-analog converters situated between the comparator unit 13 and the control devices 2 and 3 are designated by reference numeral 17. In the case of FIG. 3, the comparator unit 13 is a PI controller.

For ensuring the air balance, it is necessary to know the amount $q_2$ of the air taken from the inside. In the principle, this could be measured by means of flow meters, but for the economy in space utilization and equipment expenses, it is advisable to carry out the measurement in the following manner. The temperatures $t_1$ and $t_2$ of the part flows entering the mixing section are measured by means of the sensors T(1) and T(2), respectively. The combined air flow of these air flows, that is the combustion air flow $q_{1+2}$, is measured by means of a flow meter 6, which is situated in the combustion air duct C after the mixing section 1. In FIG. 1 the flow meter is a venturi situated after the combustion air fan 4 and air heater 5. These flow data are used for combustion control, and the data are converted to normal cubic meters per second [$nm^3/S$]. By means of the measured air flows $q_{1+2}$ and temperatures $t_1$, $t_2$ and $t_{mix}$, the air flow $q_2$, to be taken directly from the inside of the boiler building to the mixing section 1 of the combustion air can be calculated. These air flow data are used for controlling the inlet air equipment (devices 7 to 11) of the boiler building in such a manner that the combustion air flow $q_2$, to be taken from the inside of the boiler building and the inlet air flow $q_c$ (devices 7 to 11 ), are always well balanced, that is, in a desired proportion to each other. In FIG. 1 this inlet air equipment comprises an outlet fan 7, inlet air fans 8, 9 and 1 0, and a central ventilation unit 11 comprising a heater and a fan. The balance is ensured by means of temperature measurements located in the lower and upper parts of the boiler room in such a manner that in the lower part the temperature is not allowed under any circumstances to decrease below, nor in the upper part to increase above, the guarantee values ($t_{min}$ and $t_{max}$ respectively).

The need for the inlet air can be calculated in the following manner:

The energy balance of one mixing section 1 is calculated as follows:

$$c_1q_1t_1+c_2q_2t_2=c_{mix}q_{1+2}t_{mix} \quad (1)$$

wherein $c_1$, $c_2$ and $C_{mix}$ are the thermal capacities of the corresponding flows. In the equation (1) the ratio $q_1/q_2$ and $q_2$ can be solved, because it is given that $q_1+q_2=q_{1+2}$. When the flow rates are calculated, the density and specific heat of the air as a function of temperature are taken into account.

A black liquor recovery boiler contains as a rule several combustion air levels, that is, a primary, secondary and tertiary level. The air flow to be replaced using all inlet air devices=$q_{1+2}$ (primary)+$q_{1+2}$ (secondary) +$q_{1+2}$ (tertiary)+ process exhaust. By "process exhaust" it is meant exit of gases to the outside air from a smelt dissolving tank below the boiler. Consequently, the combustion air flow to be taken from the inside is constituted in the following manner: $q_2=q_2$ (primary)+$q_2$ (secondary) +$q_2$ (tertiary). Each level may have a system and a mixing section of its own, or several or all levels can have a joint system and mixing section.

Figure 4:
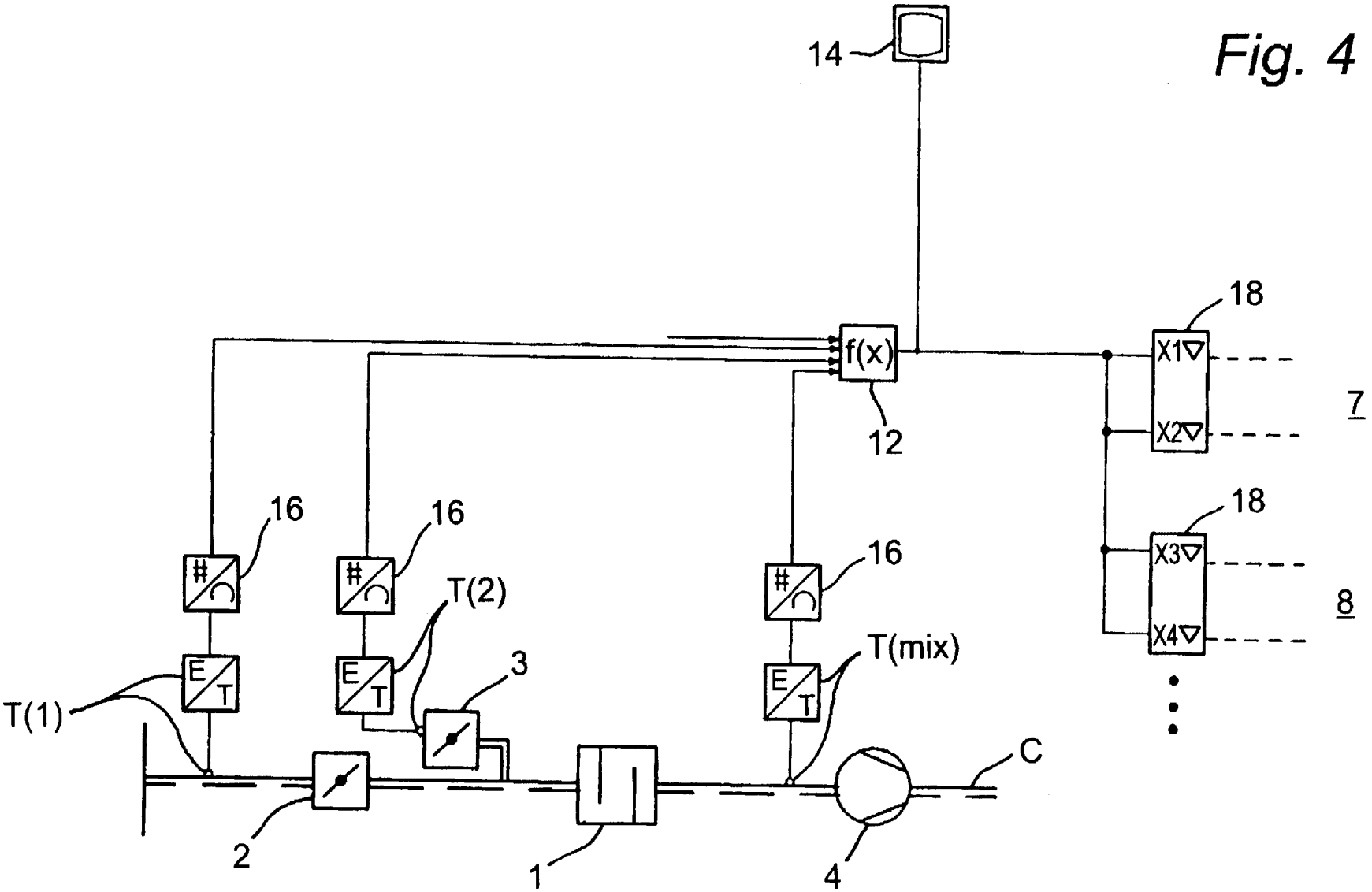
FIG. 4 shows another control diagram for the apparatus according to the invention.

FIG. 4 shows a control diagram for carrying out the adjustment of the inlet air $q_c$ . Parts with corresponding function are designated by the same reference numerals as in FIG. 3. The temperature of the outside air is measured by means of a sensor T(1) and the temperature of the air entering from the inside is measured by means of the sensor T(2). These data together with the temperature data given by the sensor T(mix) are transmitted to the computing section 12, which receives also the data about the total amount of the combustion air flow. The need for the inlet air is calculated by the computing section, which will switch the fans 7 to 11 on or off on the basis of the result. The situation can be monitored in the control room 14. Reference numeral 18 designates limit comparisons, which are situated between the computing section 12 and the fans, and by means of which the fans are controlled based on the value of needed inlet air given by the computing section 12.

The control of the inlet air equipment according to the combustion air flow ensures the balance of the air streams in the boiler room and consequently, the maintenance of the desired interior temperatures and pressure differences, whereby the risks of excess heating or freezing in the plant are avoided. The heat received from the boiler and its equipment in the boiler room can be recovered in a controlled manner for the preheating of combustion air while the temperature limitations set by the environment are, at the same time, taken into account. In case of failure of the inlet air equipment, the proportion of the combustion air from the outside can be increased to correspond to the air flow of the failed part of the equipment during the period of its reparation, in which event the manual adjustment shown in FIG. 3 can be employed.

Figure 5:
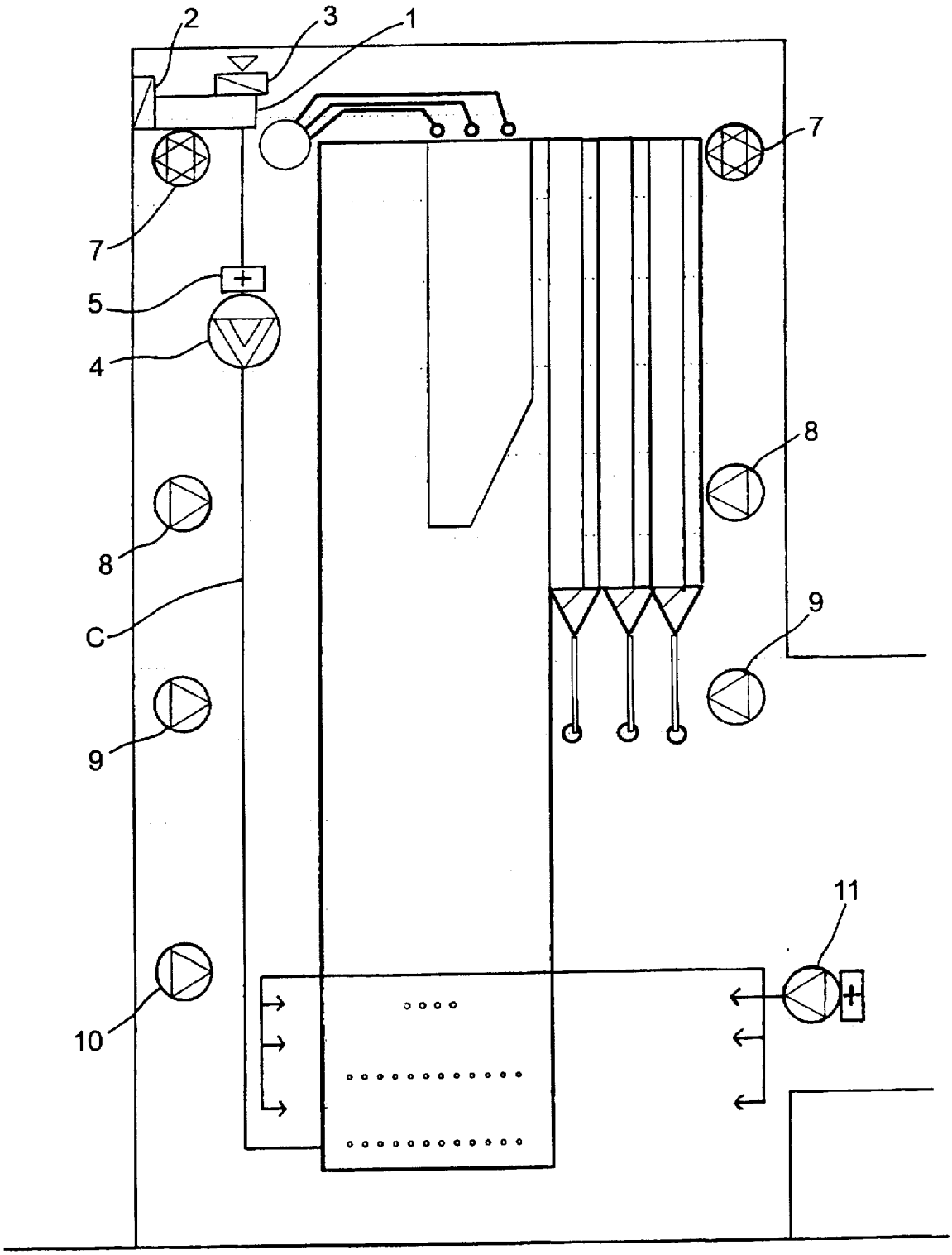
FIG. 5 shows a boiler plant containing the apparatus according to the invention.

FIG. 5 shows a boiler plant including the apparatus according to the invention and showing the same numerals as in FIG. 1 for the equivalent parts. The mixing section 1 is placed in the upper part of the boiler building in the beginning of a vertical air duct C.

The corresponding system including the mixing section, can also be in the secondary air duct and, when needed, also in the tertiary air duct. In this case, all the mixing sections can have the same set value, but the set values can also be allotted separately to each mixing section. Several air ducts can further have a joint mixing section, whereafter the ducts branch off.

The invention is not restricted to the above-described embodiment, but it can be varied within the inventive concept defined by the appended claims. The method can for example be applied in all air ducts of the boiler or only in a part of them, for example in a black liquor recovery boiler both in the primary and secondary combustion air duct, as well as also in the tertiary combustion air duct when necessary.

We claim:

1. An apparatus for controlling combustion air in a boiler plant comprising:

a combustion air duct for conveying combustion air into a boiler located in a boiler building, said boiler having a load;

a mixing section, provided in said combustion air duct, said mixing section being connected inside of said boiler building for supplying a flow of inside air thereto and also being connected outside said boiler building for supplying a flow of outside air thereto, said outside air being at a certain temperature;

control devices located in said mixing section, said control devices mixing said inside air flow and said outside air flow in a desired ratio into a total air flow entering the combustion air duct, said desired ratio being defined by quantities of said air flows, said total air flow being at a certain temperature depending on said inside and outside air flows;

means for measuring the temperature of the air flow in said conduction air duct located after said mixing section in a flow direction of said air flow;

a comparator unit communicating with said means for measuring, said comparator unit being arranged to control said control devices of said mixing section for adjusting said desired ratio of said inside air flow and said outside air flow;

a meter for measuring said load of said boiler and the temperature of the outside air, said meter being connected to a computing section, said computing section being arranged to calculate a set value for said comparator unit at least on the basis of data received from said meters.

2. An apparatus according to claim 1, wherein said computing section further comprises means for calculating the quantity of air flow to be taken from the inside on the basis of data received from different air flows.

3. An apparatus according to claim 2, wherein said computing section further comprises calculating means connected to means for adjusting at least one of an air inlet and outlet equipment, said means adjusting a flow of inlet air to be conveyed into the building.

4. An apparatus according to claim 1, wherein said boiler plant comprises several combustion air ducts, and said mixing section is common to at least two of said combustion air ducts.

5. An apparatus according to claim 4, wherein said boiler is a black liquid recovery boiler burning spent liquor of pulp manufacturing industry.

6. An apparatus according to claim 1, wherein said boiler plant comprises several combustion air ducts, and a separate mixing section is provided for each combustion air duct.

7. An apparatus according to claim 6, wherein said boiler is a black liquid recovery boiler burning spent liquor of pulp manufacturing industry.

8. An apparatus according to claim 1, wherein said boiler is a black liquid recovery boiler burning spent liquor of pulp manufacturing industry.

9. An apparatus for controlling combustion air in a boiler plant comprising:

a combustion air duct for conveying combustion air into a boiler located in a boiler building and having a load; a mixing section located in said combustion air duct, said mixing section being connected both inside of the building for supplying inside air thereto and outside of the building for supplying outside air thereto, the outside air being at a certain temperature;

control devices provided in said mixing section, said control devices mixing the air flow taken from the inside and the air flow taken from the outside into a total air flow entering the combustion air duct at a desired ratio, said desired ratio being defined by quantities of said air flows and being at a certain temperature depending on the air flows;

means for measuring the temperature of the air flow located in said combustion air duct, after said mixing section in a flow direction of said air flow;

a comparator unit connected to said means for measuring, said comparator unit being arranged to control said control devices of the mixing section for adjusting said ratio of said flows to be taken from the inside and from the outside; and a computing section for calculating the quantity of air flow to be taken from the inside on the basis of data received from different air flows, said computing section communicating with said comparator.

10. A method for controlling combustion air in a boiler plant, where combustion air is supplied into a boiler located in a boiler building, said method comprising the steps of:

determining a ratio of air flow inside the building to air flow outside the building on the basis of at least the temperature of the outside air and of a load of the boiler;

taking a first air flow from inside of the building in accordance with said ratio;

taking a second air flow from outside the building in accordance with said ratio; said second air flow being at a certain temperature; and supplying a combined combustion air flow including said first and second air flows in accordance with said ratio to said boiler.

11. A method according to claim 10, used in connection with several different levels in a boiler plant comprising different combustion air levels.

12. A method according to claim 10, used in connection with controlling combustion air in a black liquid recovery boiler where spent liquor of pulp manufacturing industry is burned.

13. A method according to claim 10 further comprising the step of mixing said first and second air flows at said ratio at a beginning of a combustion air duct.

14. A method according to claim 10 further comprising the steps of:

mixing said first air flow and said second air flow into a combined air flow;

determining a set value for the temperature of the combined air flow on the basis of the temperature of outside air and said load of the boiler; and adjusting said ratio continuously for realizing said set value.

15. A method according to claim 10 further comprising the step of controlling an inlet air equipment in said boiler building on the basis of an air quantity of said first air flow.

16. A method according to claim 15 further including the following steps for calculating the air quantity taken from the inside at a certain temperature:

measuring the combustion air flow of the boiler, consisting of said first air flow taken from the inside and said second air flow taken from the outside;

measuring the temperature of said first air flow;

measuring the temperature of said second air flow; and measuring the temperature of the combined air flow of the first and second air flows.

* * * * *